US007598451B2

(12) United States Patent
Minehart, III

(10) Patent No.: US 7,598,451 B2
(45) Date of Patent: Oct. 6, 2009

(54) POROUS PLATE ROCKET TORPEDO

(76) Inventor: Robert F. Minehart, III, 37 Cedar Dr., Sterling, VA (US) 20164

( * ) Notice: Subject to any disclaimer, the term of this patent is extended or adjusted under 35 U.S.C. 154(b) by 423 days.

(21) Appl. No.: 11/602,102

(22) Filed: Nov. 20, 2006

(65) Prior Publication Data

US 2009/0071386 A1 Mar. 19, 2009

Related U.S. Application Data

(60) Provisional application No. 60/738,511, filed on Nov. 22, 2005.

(51) Int. Cl.
*F42B 19/00* (2006.01)

(52) U.S. Cl. ..... 114/20.1; 114/20.2; 102/399

(58) Field of Classification Search ..... 114/20.1, 114/20.2; 102/399
See application file for complete search history.

(56) References Cited

U.S. PATENT DOCUMENTS 6,405,653 B1 * 6/2002 Miskelly ..... 102/374
6,849,247 B1 * 2/2005 Wagaman et al. ..... 423/657
6,962,121 B1 * 11/2005 Kuklinski ..... 114/67 A
7,347,146 B1 * 3/2008 Gieseke ..... 102/399
2007/0077044 A1 * 4/2007 Kirschner et al. ..... 392/485

* cited by examiner

*Primary Examiner*—J. Woodrow Eldred

(57) ABSTRACT

The present invention includes a means to sustain a rocket torpedo's supercavation envelope to enhance the speed, maneuverability and resistance to percussion based counter measures. The invention includes machines using those aspects of the invention. The invention may also be used to upgrade, repair, or retrofit existing machines, using methods and components known in the art. The present invention comprises a porous plate technique never associated with torpedo design. This approach differs from previous efforts to apply porous plate designs to surface ships and differs as a proportional gas flow is achieved to sustain supercavation during all aspects of a torpedo travel to include but not limited cruising, diving, surfacing and while executing turns of any turning radius.

1 Claim, 1 Drawing Sheet

POROUS PLATE ROCKET TORPEDO

POROUS PLATE ROCKET TORPEDO

POROUS PLATE ROCKET TORPEDO

The present invention is a refinement of a previously submitted provisional patent by the same inventor (Robert Minehart). Patent No. 60/738,511, filed Nov. 22, 2005. This invention may be used as an improvement to Robert Kuklinski's design: U.S. Pat. No. 911,749 filed on 2004 Jul. 3. Which offers a way to introduce a supercavitating envelope by ejecting a gas via the tip of a torpedo. Likewise, there may be proprietary designs submitted at the benefit of the U.S. Department of Defense whereby the initial cavitation envelop is produced by means other than gas injection. It is important to recognize that this invention operates independent of whatever means is utilized to produce that initial (tip) cavitation and pertains to only the process of ejecting a gas via a porous plates arranged to form the outer wall (skin) of a rocket torpedo. This invention uses a porous plate skin for the ejection of bleed gas from the rocket motor's combustion chamber. Bleed gas is mixed with ambient water (water injection) and proportionally directed to the eight (8) longitudinal skin sections of the rocket torpedo, via a unique control valve (separate-future patent application) that is commanded by the torpedo's navigation control unit. This approach maintains a constant supercavitation envelope independent of depth, direction or random external pressure gradients.

This invention uses a porous plate body material arranged longitudinally to facilitate the proportionally venting of gases for the purpose of sustaining a supercavitating envelop through extreme maneuvers see FIG. 1. The ejection ratio is a function of gas vented via the porous plate skin and the volume of gas generated by the torpedo tip (either by means of a non-gas ejecting cavitator or direct gas ejection) and the sine of the torpedo turning angle. The Ejection ratio is defined as $$E = \frac{\pi L}{2D}\mathrm{Sin}(\Theta)$$

where $\pi$ denotes the constant Pi; L is the length of the torpedo; D is the torpedo diameter; and, $\theta$ is the turning angle of the torpedo with 0 degrees denotes straight travel. For example, an ejection ratio (E=1.0) would mean that an equal amount of gas is ejected via the cavitator (tip of torpedo) and the porous plate. Likewise, a ejection ratio (E=2.0) would mean that an amount of gas equal to twice the amount produced by the tip cavitator (either ejection or produced by other means) would be ejected via the porous plate skin of the torpedo. The aforementioned control valve would direct porous plate gas to one of the eight longitudinal sections that is opposite the radius of curvature of the corresponding turn.

BACKGROUND

It has been demonstrated that the hydrodynamic process known as supercavitation reduces overall drag (viscous and pressure) by a factor of 26 (Minehart, 2003). Independent of the approach to produce the supercavitation envelope, the stability of the envelope is susceptible to external shocks and abrupt turns, (Minehart, 2004). The instability of a supercavitating envelope was demonstrated when envelope closure (collapse) was achieved by the exertion of an external pressure wave with a magnitude of sixteen times (16) the oncoming dynamic pressure ($\frac{1}{2}\rho V^2$). Although it was demonstrated that the adaptation of micro-foils to a rocket torpedo would stabilize its flight and reduced adverse yawing affects (due to envelop closure) by a factor of five (5), the associated envelop closure induced a highly transient drag condition that made the torpedo unnecessarily susceptible to hostile counter-measures (Minehart, 2004).

It was demonstrated in 2005 that a porous plate torpedo skin would not only prevent envelop closure in the presence of external pressure waves, this unique approach eliminated all adverse yaw affects during extreme maneuvers (turns). The use of a porous plate gas ejection also proved, for the first time, a capability for a supercavitation torpedo to operate at substantially greater depths.

It is important to note that this invention is independent of whatever means is used to produce the supercavitating envelope, e.g., direct gas injection, an external cavitator, or a hybrid approach. The denominator of the associated ejection ratio is based on the initial tip gas volume that is independent of it means of production.

DETAILED DESCRIPTION OF THE INVENTION

Figure 1:
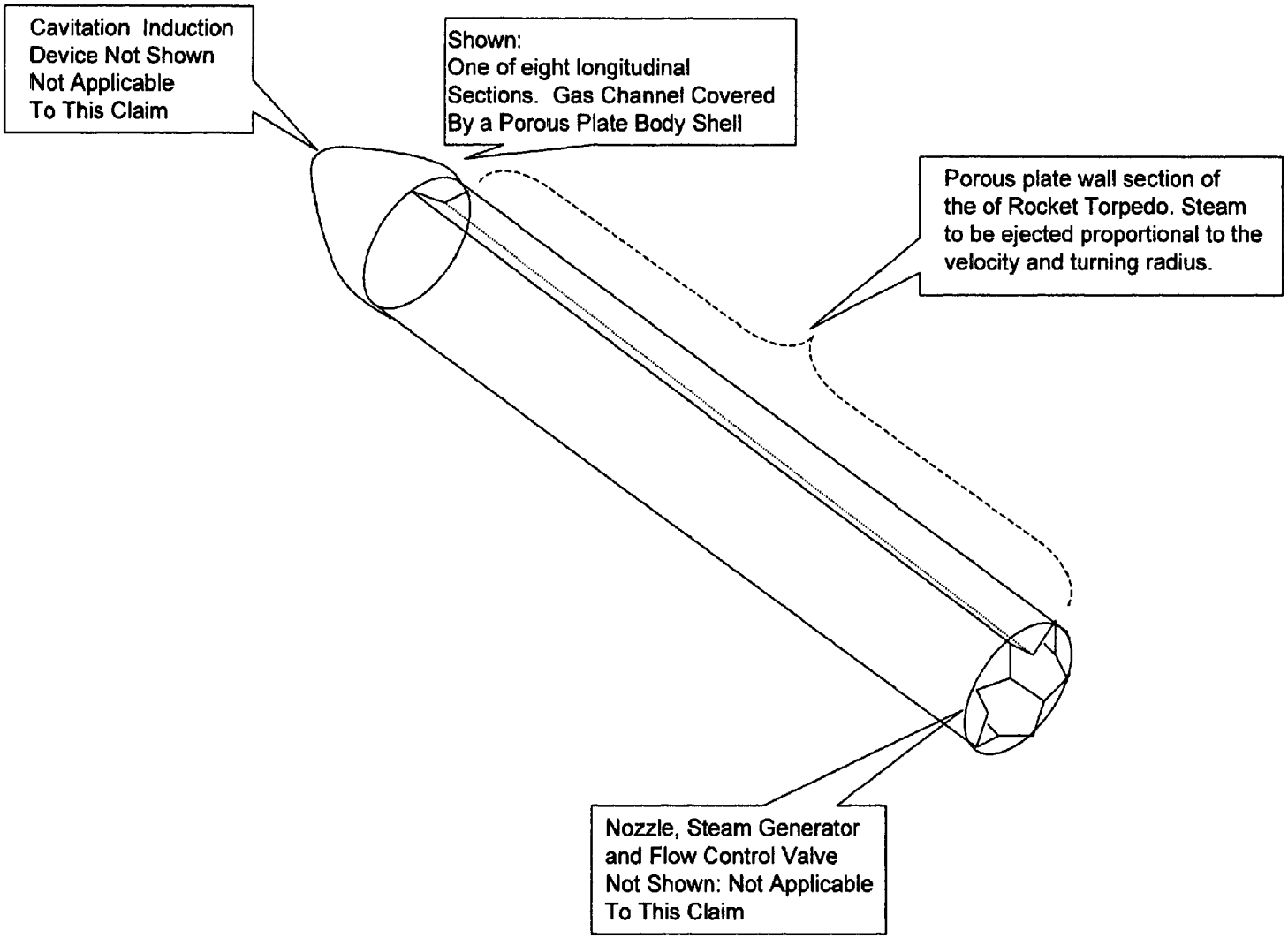
FIG. 1 illustrates the position of the eight (8) longitudinal skin sections of the rocket torpedo. This sections are composed of typical metallic plate that is manufactured to be porous. The plate composition and porous structure are independent of this process.

This invention utilizes two concentric cylindrical tubes to form the outer wall of a rocket torpedo. The outer tube is made of a porous metallic material that will allow gas to flow evenly through the outer wall of the torpedo. The inner tube is not porous and is positioned to provide a ½ inch gap between the inner and outer tubes. Welding a metal partition as shown in FIG. 1 forms eight longitudinal internal cavities.

The eight longitudinal internal cavities are equally arranged (at 45 degree intervals) around the circumference of the torpedo. Both ends of this torpedo double wall structure are closed via welded joints. Separate gas venting tubes are attached to each of the eight longitudinal sections from the inside of the torpedo at the end opposite the tip. These tubes connect and direct gas flow from the aforementioned proportion valve that is located external, but adjacent to the throat section of the rocket nozzle (Note: this is a common rocket torpedo practice for generating gas). Gas is bleed from the combustion chamber and mixed via ambient water that is collected via a (not shown) pitot tube. The pitot tube is commonly a functional part of the torpedo's control system; thus, specific detail is not necessary.

The invention claimed is:

1. A rocket torpedo having a self contained rocket motor and a cavitation induction device for creating a flow of gas at a forward tip of said torpedo to thereby create a supercavitating gas envelope surrounding said torpedo during propulsion, the improvement comprising, multiple longitudinal gas channels running along the torpedo, each of said gas channels covered by a porous material such that any gas injected into the gas channel will eject through said porous material, means for selectively injecting gas selectively into each gas channel to thereby create a flow of gas into the selected gas channel and a flow of gas through the porous material covering said selected gas channel, where the ratio of the gas flow at the tip of the torpedo to the flow of gas through the porous material of the selected gas channel is defined by the equation, $$E \propto \frac{\pi L}{2D}\sin(\theta)$$

where L is the length of the torpedo, D is the diameter of the torpedo and Θ is the turning angle of the torpedo where 0 degrees denotes straight travel.

* * * * *